US011351403B2

(12) United States Patent
Sands

(10) Patent No.: US 11,351,403 B2
(45) Date of Patent: Jun. 7, 2022

(54) SOFT SEAL BOTTLE BAND

(71) Applicant: Patricia C. Sands, Arlington, VA (US)

(72) Inventor: Patricia C. Sands, Arlington, VA (US)

( * ) Notice: Subject to any disclaimer, the term of this patent is extended or adjusted under 35 U.S.C. 154(b) by 0 days.

(21) Appl. No.: 17/005,295

(22) Filed: Aug. 27, 2020

(65) Prior Publication Data

US 2021/0162242 A1 Jun. 3, 2021

Related U.S. Application Data

(60) Provisional application No. 62/893,176, filed on Aug. 28, 2019.

(51) Int. Cl.
*A61G 9/00* (2006.01)
*A61Q 19/00* (2006.01)

(52) U.S. Cl.
CPC ..... *A61Q 19/005* (2013.01); *A61G 9/006* (2013.01); *A61G 2203/70* (2013.01)

(58) Field of Classification Search
CPC ... A61G 9/006; A61G 2203/70; A61Q 19/005
USPC ..... 4/144.1
See application file for complete search history.

(56) References Cited

U.S. PATENT DOCUMENTS 3,923,040 A * 12/1975 Beach ..... A61B 10/0045 600/573
4,121,306 A * 10/1978 Bringman ..... A61G 9/006 4/144.3
6,021,530 A * 2/2000 Davis ..... A61G 9/006 4/144.1
2017/0224525 A1* 8/2017 Davis ..... A61F 5/453

* cited by examiner

*Primary Examiner* — Huyen D Le
(74) *Attorney, Agent, or Firm* — Michael J. Foycik, Jr.

(57) ABSTRACT

A band of stretchable material has dimensions suitable to be stretched over the neck of a urinal bottle. The neck has exposed edges that can come into contact with a user's hand, arms, male member, and/or any other portions of a user's anatomy, and the band is sized so that it covers those edges of the bottle neck. The band has a length and a diameter, and that diameter is smaller than the diameter of the neck in a urinal bottle. That way, when stretched over the neck, the bank will cover the edges of the neck of the bottle. In use, the band will also cover at least some portion of the opening in the neck of the urinal bottle.

2 Claims, 6 Drawing Sheets

SOFT SEAL BOTTLE BAND

CROSS REFERENCE TO RELATED APPLICATIONS

This application claims the priority of Provisional Application No. 62/893,176 filed on Aug. 28, 2019, inventor Patricia Carol Sands, entitled "Soft Seal Bottle Band". The entire disclosure of this provisional patent application is hereby incorporated by reference thereto, in its entirety.

STATEMENT REGARDING FEDERALLY SPONSORED RESEARCH OR DEVELOPMENT

Not applicable.

FIELD OF THE INVENTION

The present invention relates to device and method for sealing an opening in a urinal bottle or other bottle applications, and for providing protection against rough bottle edges; the invention also relates to an improved seal between the bottle neck and a cap or screw cap that is fastened onto the bottle neck.

BACKGROUND OF THE INVENTION

It is a problem in the art to provide protection against rough bottle edges for a urinal bottle, and also to provide an improved seal between the urinal bottle neck and a cap that is fastened onto the urinal bottle neck or other bottle applications.

It is also a problem in the art to provide an improved seal between the bottle neck and a cap or screw cap that is fastened onto the bottle neck.

SUMMARY OF THE INVENTION

From the foregoing, it is seen that it is a problem in the art to provide a device meeting the above requirements. According to the present invention, a device is provided which meets the aforementioned requirements and needs in the prior art.

The device of the present invention provides protection against rough bottle edges for a urinal bottle, and also to provide an improved seal between the urinal bottle neck and a cap or screw cap that is fastened onto the urinal bottle neck or other bottle applications.

The invention is directed to use of a band of stretchable material, having dimensions suitable to be stretched over the neck of a urinal bottle, to cover the outer edges of the neck and well as to cover the inner edge of the neck. The inner edge of the neck includes exposed edges that can come into contact with a user's hand, arms, male member, and/or any other portions of a user's anatomy, and the band is sized so that it covers those edges of the bottle neck.

The depth of the band and the ratio of tension to the size of the opening keeps the band on, even after continuous uses and lid openings and closings.

The band is in the form of a loop that has a height and a diameter, and that diameter is smaller than the diameter of the neck in a urinal bottle. The band diameter is sufficiently large, that a first end of the band can be stretched over the neck of the bottle and pulled along it, while a second end of the band remains over the rim of the neck. In this way, when stretched over the neck, the band will cover the edges of the neck of the bottle or other bottle applications. In use, the band will also cover at least some portion of the opening in the neck of the urinal bottle or other bottle applications.

Other objects and advantages of the present invention will be more readily apparent from the following detailed description when read in conjunction with the accompanying drawings.

DETAILED DESCRIPTION OF THE INVENTION

Figure 1:
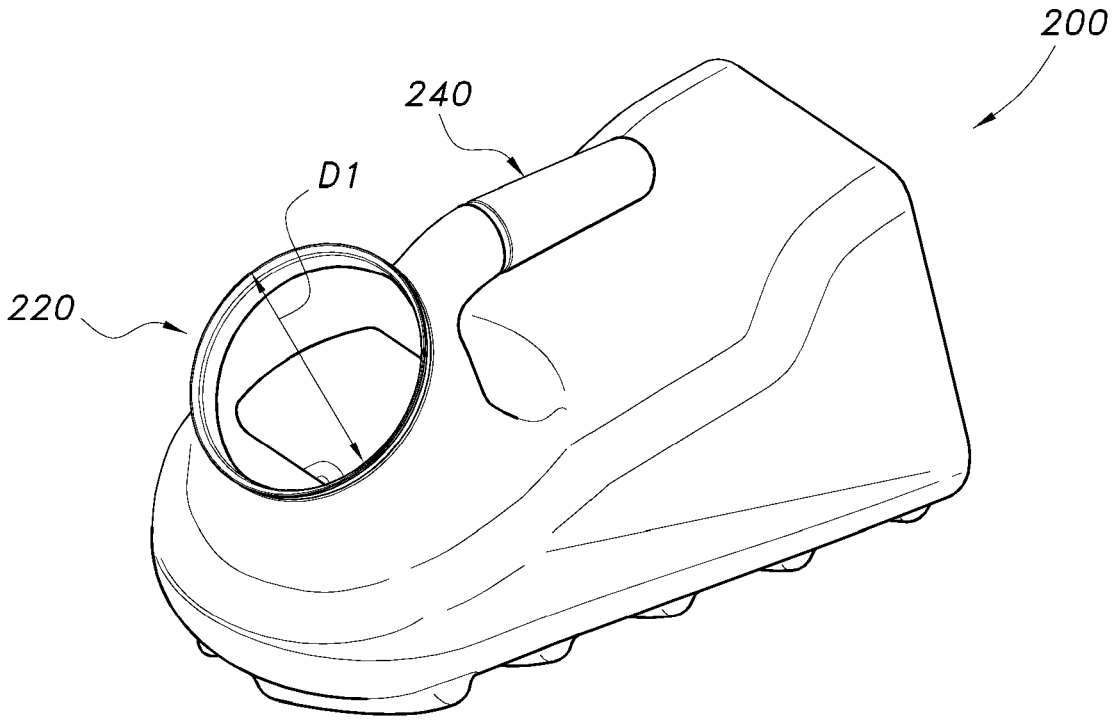
FIG. 1 is a perspective view of a bottle, which is used in the invention.

FIG. 1 is a perspective view of a bottle 200, which is used in the invention. The bottle 200 has a handle portion 240, and a neck 220 portion having a diameter D1. The bottle 200 is as described in U.S. Pat. No. 9,622,930, which is incorporated herein in its entirety by reference thereto.

The bottle 200 can be any bottle with a neck portion having an opening; in the preferred embodiment the bottle 200 is a urinal bottle 200. The neck portion 200 has an outer surface and an inner top edge. The inner top edge being relatively thin and having sharp edges, there is a chance of injury when coming into contact with a human appendage.

Figure 2:
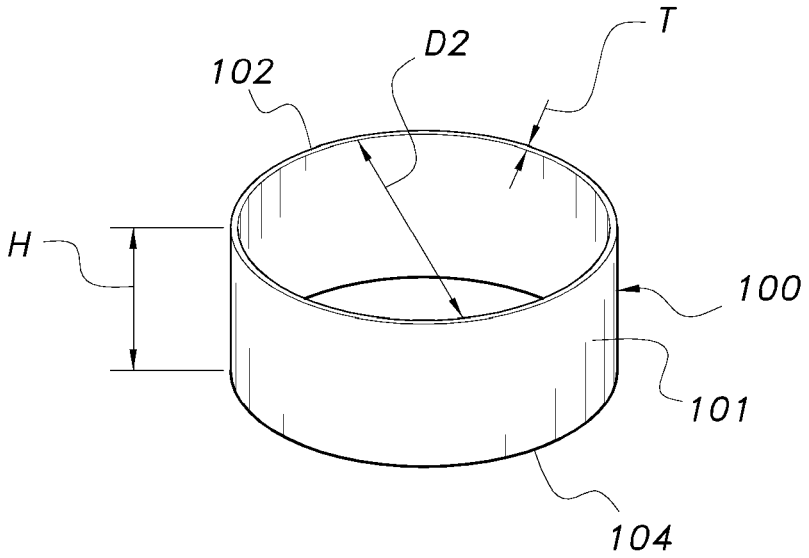
FIG. 2 is a perspective view of a band, used in the present invention.

FIG. 2 is a perspective view of a band 100, used in the present invention. The band 100 has a first edge 102, also referred to herein as a top edge 102; a second edge 104, also referred to herein as a bottom edge 104. As shown in FIG. 2, the band 100 has a thickness T (denoted by the double arrows in FIG. 2), a height H (as indicated by the double-headed arrow in FIG. 2), and has a band diameter D2 (as shown by the double-headed arrow in FIG. 2).

In the preferred embodiment, the height H is approximately 2.6 cm, the thickness T is approximately 0.1 cm, and the diameter D2 (the unstretched diameter) is approximately 5.0 cm. The diameter D1 (of the neck portion 220 of the container 200) in the preferred embodiment is approximately 7.3 cm. Thus, the lower portion of the band 100 is stretched from 5.0 cm to about 7.3 cm during assembly of the band 100 onto the neck portion 220.

The band 100 has a body portion 101, also referred to herein as a wall 101, forming the band 100. The band 100 is composed of a flexible, stretchable material.

In the preferred embodiment, the band 100 is composed of silicone. The band is waterproof and hypoallergenic. The band 100 fits over the opening in the neck portion 220, and over the outer edges of the neck portion 220. This is discussed below.

This band can be adapted to many sizes to accommodate needs of different bottle types. The optimal material is silicone as: 1) silicone does not lose its shape, 2) is easy to clean, and 3) is non-allegenic to frail users. A different material can be used for the band, e.g. nitrile, though that is less preferable.

The depth of the band and the ratio of tension to the size of the opening keeps the band on, even after continuous uses and lid openings and closings. The width of the band is proportioned to not slip off the bottle after repeated uses and removal of the cap or lid.

The silicone band can be parallel to the opening or covering flatly the entrance to the bottle depending on the adjustment of the user.

The band can be adapted to many sizes to accommodate needs of different bottle types.

Figure 3:
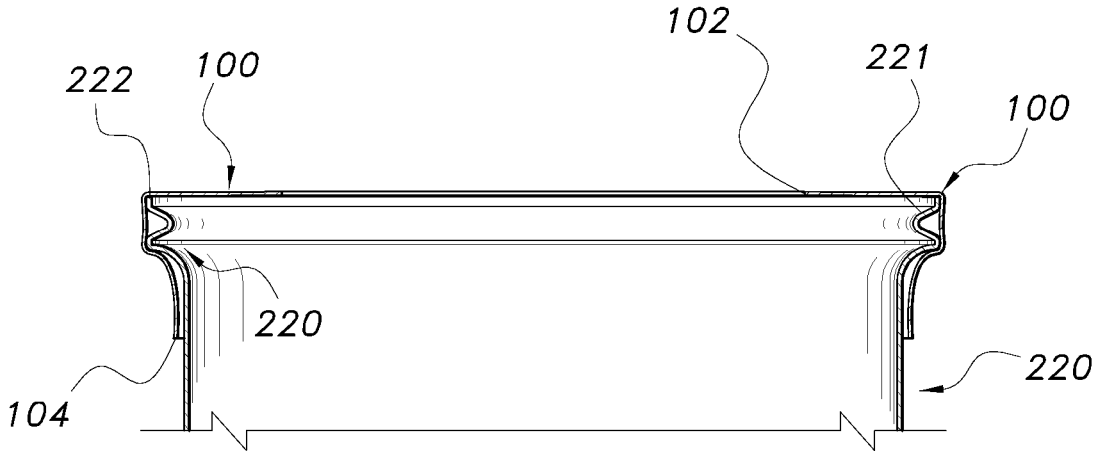
FIG. 3 is a cross-section taken along a diameter of an opening in the neck of a bottle, showing a lower (second) portion of the band in place on the neck of the bottle and showing an upper (first) portion of the band extending across the opening in the neck of the bottle and partially closing the opening.

FIG. 3 is a cross-section taken along a diameter of an opening in the neck portion 220 of the bottle 200. In this view, the neck portion 220 has an inner wall 221 bounding the opening in the neck portion 220, the neck portion 220 having an uppermost edge portion 222.

As shown in FIG. 3, the lower portion of the band 100 having the bottom edge 104 extends along the outer periphery of the neck portion 220. the upper portion of the band 100 including the upper edge 102 extends only partially across the opening of the neck portion 220 of the bottle 200. This view shows that the upper portion of the band 100 extends across the opening in the neck 220 of the bottle 200, and partially closing the opening.

Figure 4:
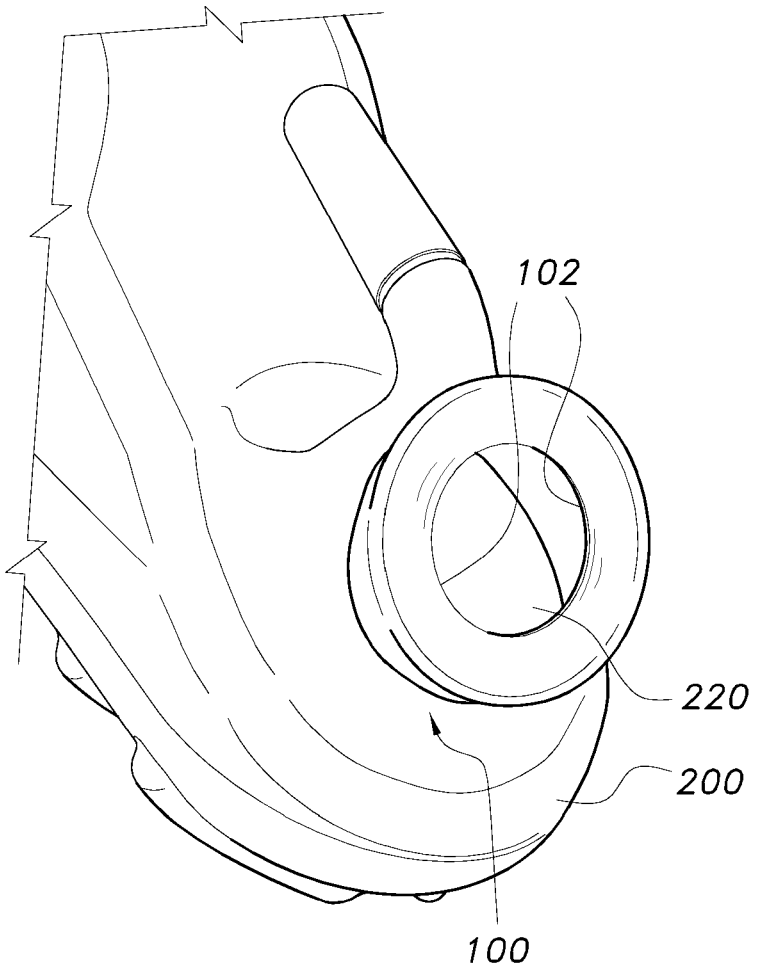
FIG. 4 is a perspective view of the arrangement accordingly to FIG. 3, showing the band mounted on the neck of the bottle, the view being orthogonal to the plane of the opening in the bottle.

FIG. 4 is a perspective view of the arrangement accordingly to FIG. 3, showing the band 100 mounted on the neck portion 220 of the bottle 200, the view in this figure being orthogonal to the plane of the opening in the neck portion 220 of the bottle 200.

Figure 5:
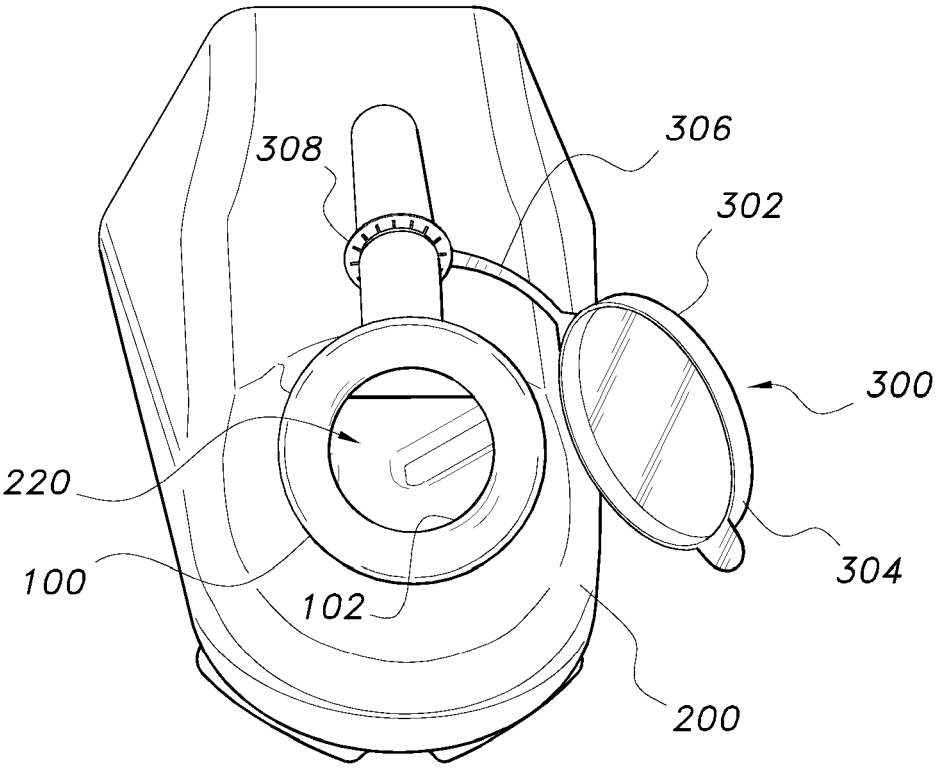
FIG. 5 is a perspective view of a lid having a connector portion attached to the bottle of FIG. 4, the lid being adapted to cover the opening of the bottle so as to cover the band.

FIG. 5 is a perspective view of a lid 300 having a cover portion 302, a ring portion 308, and a connector portion 306 connecting the ring portion 308 with the cover portion 302. In the preferred embodiment, the portions 302, 306, and 308 are formed as an integral member 300, and can be formed of plastic or other material usable for a lid. The ring portion 308 is attached to a handle portion 240 (shown in FIG. 1 and FIG. 5) of the bottle 200. The lid 300 is adapted to cover the opening of the bottle 200 so as to cover the band 100.

Figure 6:
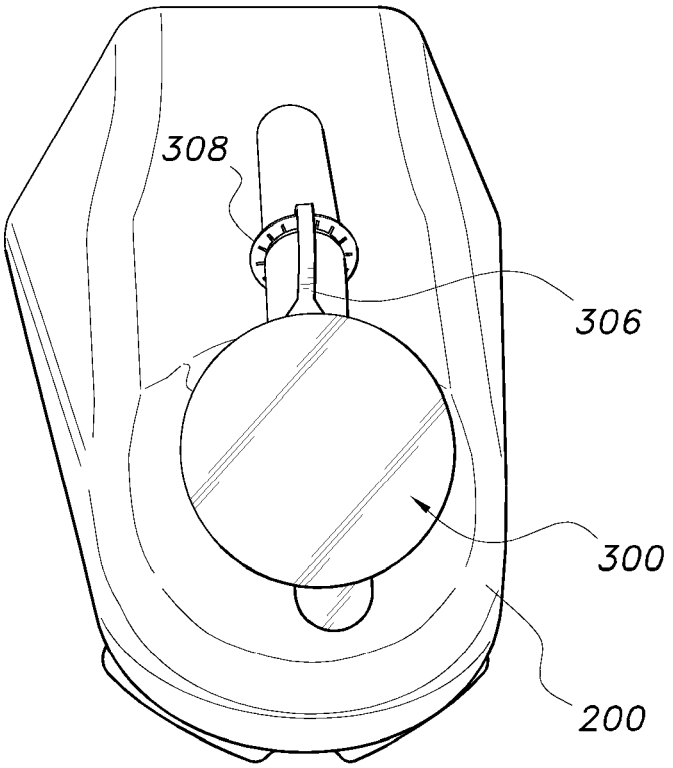
FIG. 6 is a perspective view of the lid and bottle of FIG. 5, wherein a cover portion of the lid is mounted securely on the neck of the bottle.

FIG. 6 is a perspective view of the lid 300 and the bottle 200 of FIG. 5, wherein the cover portion 302 of the lid 300 is mounted securely on the neck portion 220 of the bottle 100.

As can be seen in FIGS. 1-6 the band 100 fits over the urinal opening in the urinal 200, and in the preferred embodiment it fits tightly. The lid 300 in the preferred embodiment fits tightly over the band 100 in sealing engagement, to prevent spilling of liquid when the urinal 200 is tipped, and fits sufficiently tightly so that liquid in the urinal 200 does not spill even when the urinal 200 is inverted. The band 100 facilitates such sealing engagement. That is, the band 100 is thin, and the lid 300 fits tightly over the band 100, forming a strong sealing engagement. Further, the band 100 covers the opening and neck portion 220 without slipping off.

Furthermore, as shown in the above, part of the upper portion of the band 100 forms a soft edge for body contact (i.e., contact with a human body). This lessens skin irritation. The outside portion of the neck portion 220 is covered by the band 100, also lessening skin irritation.

The band 100 helps with spill prevention, since even if the urinal 200 is tipped at an angle, liquid in the urinal 200 is stopped from flowing out by the upper portion of the band 100 which partially covers the opening in the neck portion 220 of the urinal 200.

The band 100 is assembled onto the neck portion 220 by manually pulling the lower portion of the band 100 outwardly until it can fit over the neck portion 220. The band is then pulled downwardly onto the neck portion 220, so that the band 100 continues to stretch, and this continues until a portion of the band 100 is disposed on the neck sufficient to retain the band 100 in place. The upper edge 102 of the band 100 retains its circular shape, and the band 100 naturally flattened in the region over the opening in the neck portion 220.

Figure 7:
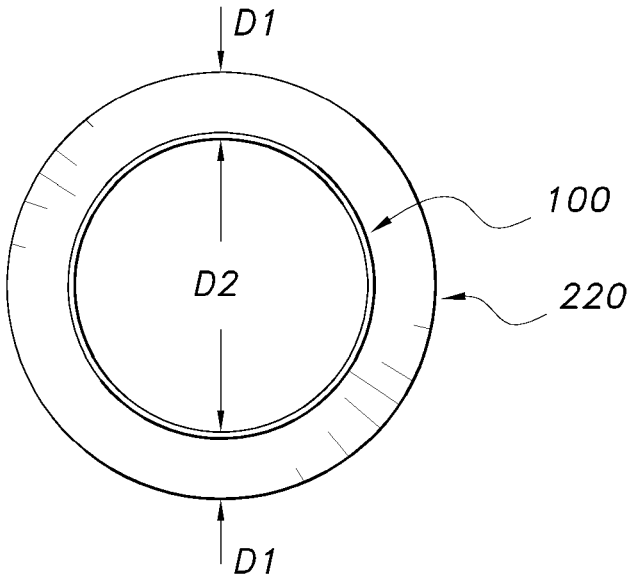
FIG. 7 is a top view of the band of the present invention wherein the bottom portion is being stretched over the neck of the bottle (not shown in this view) to extend to the diameter of the neck, while the top portion of the band is in its initial shape having an initial diameter which is less than the diameter of the neck.

FIG. 7 is a top view of the band of the present invention wherein the bottom portion is being stretched over the neck portion 220 of the bottle 200 (not shown in this view) to extend to the diameter D1 of the neck portion 220, while the top portion 102 of the band is in its initial shape having an initial diameter D2 close to its original undeformed diameter, which is less than the diameter D1 of the neck portion 220, such that the band 100 partially covers the opening.

Figure 8:
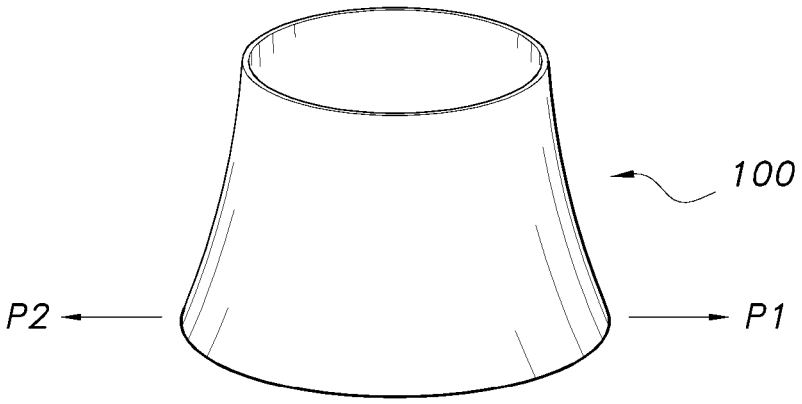
FIG. 8 is a perspective view of the band shown in FIG. 8, schematically showing direction of outward pulling of the bottom portion of the band, which is enlarged to correspond to the diameter of the neck portion.

FIG. 8 is a perspective view of the band shown in FIG. 8, schematically showing direction of outward pulling of the bottom portion of the band 100, which is enlarged to correspond to the diameter of the neck portion 220.

The device of the present invention provides protection against rough bottle edges for a urinal bottle, and also to provide an improved seal between the urinal bottle neck and a cap or screw cap that is fastened onto the urinal bottle neck or other bottle applications.

The invention is directed to use of a band of stretchable material, having dimensions suitable to be stretched over the neck of a urinal bottle, to cover the outer edges of the neck and well as to cover the inner edge of the neck. The inner edge of the neck includes exposed edges that can come into contact with a user's hand, arms, male member, and/or any other portions of a user's anatomy, and the band is sized so that it covers those edges of the bottle neck.

The depth of the band and the ratio of tension to the size of the opening keeps the band on, even after continuous uses and lid openings and closings.

The band is in the form of a loop that has a height and a diameter, and that diameter is smaller than the diameter of the neck in a urinal bottle. The band diameter is sufficiently large, that a first end of the band can be stretched over the neck of the bottle and pulled along it, while a second end of the band remains over the rim of the neck. In this way, when stretched over the neck, the band will cover the edges of the neck of the bottle or other bottle applications. In use, the band will also cover at least some portion of the opening in the neck of the urinal bottle or other bottle applications.

The following is a discussion of materials which are usable in the present invention. A material that is preferred is silicone for the above-noted purposes, but the present invention is not limited to any one material. Instead, the invention is intended to encompass all suitable materials which would be known to any one having skill in the sealing arts and flexible waterproof material arts.

Silicone is a type of thermoset elastomer. silicone is a non-toxic polymer mostly made from silica (sand). It can withstand heating and freezing without leaching or off-gassing, hazardous chemicals—unlike plastics, which contaminate food in these environments.

TPE is a Type of Thermoplastic Elastomer.

1. TPE is a general term of a variety of elastomeric materials with the characteristics of elastic rubber and melt-flowable elastomer at high temperature.

Silicone rubber is a special kind of rubber. It has good mechanical strength, abrasion resistance and high temperature resistance after being crosslinked. It belongs to a kind of thermoset rubber, will not melt after being vulcanized and heated, will burn when the temperature is excessively high, and will yield water and silica after complete combustion.

2. Different structural analysis: Silicone is an elastomer composed of a chain of silicon-oxygen links, and with a general side chain of CH3. TPE is a thermoplastic elastomer composed of styrene, olefins and polyurethanes. The main difference is that silicon has a molecular structure of SI02, and TPE has a molecular structure of CC.

3. From processing performance perspective: Silicone needs to be molded through vulcanization, but TPE can be molded without vulcanization. Silicone is more difficult to be processed and molded, while the production and processing of TPE is simpler.

4. Silicone has an advantage over TPE in high temperature. The temperature resistance range of silicone is 200~300° C., while that of TPE is theoretically 130° C.~150° C., and above that range, TPE will age and crack.

5. Prices of silicone rubber are higher than TPE. TPE has an advantage of being cheaper. Except for special TPE materials, silicon has such merits as halogen-free, flame retardant, food-grade proper, etc.

6. From cost perspective, silicone wastes cannot be recycled, whereas TPE wastes, nozzle residues and edge materials can be fully recycled and reused. Thus, TPE is more cost effective.

Nitrile: Nitrile rubber, also known as NBR, Buna-N, and acrylonitrile butadiene rubber, is a synthetic rubber copolymer of acrylonitrile (ACN) and butadiene. . . . Nitrile rubber is more resistant than natural rubber to oils and acids, and has superior strength, but has inferior flexibility.

Rubber

Types of Rubber Used in Making Medical Products

Natural Rubber
Butadiene Rubber (BR)
Butyl Rubber (IIR)
Ethylene Propylene Diene Monomer (EPM, EPDM)
Fluoroelastomers (FKM)/Viton
Isoprene Rubber (IR)
Nitrile Rubber (NBR)
Silicone Rubber (SiR)
Styrene Butadiene Rubber
Latex: Latex for Medical Devices Latex has a natural, milky-white and thick colloidal suspension, which many people recognize in the form of latex rubber gloves. Skilled tappers must cut the bark at the appropriate depth in order to avoid damaging the tree; by properly cutting the tree, it will produce latex for a number of years, without causing harm to its overall health. The fluid actually flows into the damaged area on the tree directly below the surface of the bark. Most people learn that latex comes from the sap of the Hevea tree, native to Brazil.

After the removal of the latex from the trees, suppliers add ammonia-based preservatives, which inhibit microbial spoilage. Latex manufacturers use a variety of processes, such as the following: Creaming CentrifugationEvaporation These processes produce a concentrated form of latex material. The blending of different chemical additives along with the concentrated latex facilitates vulcanization, binds the materials and reduces degradation. The finished latex material offers the advantage of flexibility. It also has the ability to withstand bending, elongation or pulsating forces.

For decades, the medical industry has used natural latex products as tourniquets and as tubing for devices used for fluid transfer. The human immunodeficiency virus (HIV) pandemic, which occurred in the 1980s, led to a significant rise in demand for latex gloves and condoms. The increased usage of latex during this period overlaps with the rise in reports of latex allergies.

According to some reports, between 8 and 17 percent of healthcare workers have latex allergies, but such allergies are not limited to workers in the medical field. People with spinal cord problems, such as Spina Bifida patients, who have had repeated exposure to latex catheters for example, have also been impacted. Children with Spina Bifida have shown sensitivity to latex, ranging from 30 to 41 percent.

In 2014, the FDA finalized its policy recommendation for medical device manufacturers. If using natural rubber latex (NRL) proteins to affix labels to products, you should warn customers of the presence of NRL. Even if a medical product claims to be latex-free, it is not guaranteed because of the inability to verify the declaration. Instead, the FDA advises companies to use the following language: "not made with natural rubber latex."

The invention is a band 100 of stretchable material, having dimensions suitable to be stretched over the neck of a urinal bottle or other bottle applications. The neck 220 has exposed edges that can come into contact with a user's hand, arms, male member, and/or any other portions of a user's anatomy, and the band is sized so that it covers those edges of the bottle neck 220.

The band 100 has a length and a diameter, and that diameter is smaller than the diameter of the neck 220 in a urinal bottle 200. That way, when stretched over the neck, the band 100 will cover the edges of the neck 220 of the bottle 200. In use, the band 100 will also cover at least some portion of the opening in the neck 220 of the urinal bottle 200 or other bottle applications.

The band 100 is a soft stretch loop, which can be composed for example of silicone or nitrile. It is composed of a material that is waterproof and hypoallergenic. The edge of the band 100 that covers the edges of the neck 220 forms a soft edge for body contact. The outside edges of the neck 220 are likewise covered by the band 100, lessening skin irritation. The band helps with spill prevention, as discussed with respect to FIG. 4. The bottle 200, when sealed with the band 100 and covered by its lid as in FIG. 4, is spill-proof when inverted.

The purpose of the band 100 is to provide a number of advantages: (a) the soft material of the band 100 protects the frail skin from rough edges of the opening—inside and out—which result from manufacturing of the bottle 200; (b) the band 100 is tightly stretched onto the bottle 200 and can be removed and cleaned; (c) the band 100 forms a seal such that when the lid is fitted, it forms a spill-proof bottle; (d) the band 100 can help prevent skin breakdowns and urinal spills; and (e) the band 100 is relatively low in cost and provides a world-wide solution with male incontinence and travel needs.

The soft seal bottle band 100 has use and need in any bottle application where a liquid needs to be contained and spill proof when capped or screwed. This band 100 will be useful and can be manufactured in many sizes as needed.

The invention being thus described, it will be evident that the same may be varied in many ways by a routineer in the applicable arts. Such variations are not to be regarded as a departure from the spirit and scope of the invention and all such modifications are intended to be included within the scope of the claims.

The invention claimed is:

1. A combination of a urinal and a band, comprising in combination:

a urinal adapted to contain liquid, said urinal having a neck portion, and said neck portion having an opening adapted for passage of liquid;

said neck portion having a neck diameter;

a band composed of stretchable material, said band having a thin body, said thin body having an upper portion and a lower portion, said thin body having a height, and said band having a band diameter less than said neck diameter;

said band having a first condition which is an undeformed configuration which is substantially cylindrical; and said band having a second condition when installed such that said lower portion of said band being stretched over and surrounding said neck portion, and said upper portion of said band being disposed over said opening of said neck portion so as to partially cover said opening so as to form a generally circular flat opening over said neck;

whereby said band protects again spilling and prevents contact of a user's body with edges of said neck portion.

2. A device as claimed in claim 1, wherein said band is composed of silicone and is durable, washable, and non allergenic, and can be used repeatedly without losing its shape and stretch.

* * * * *